US009795190B2

(12) United States Patent
Burt et al.

(10) Patent No.: US 9,795,190 B2
(45) Date of Patent: Oct. 24, 2017

(54) TRACTION CLEAT AND RECEPTACLE

(71) Applicant: Pride Manufacturing Company, LLC, Brentwood, TN (US)

(72) Inventors: John Robert Burt, Chandler, AZ (US); Lee P. Shuttleworth, Birmingham (GB)

(73) Assignee: Pride Manufacturing Company, LLC, Brentwood, TN (US)

( * ) Notice: Subject to any disclaimer, the term of this patent is extended or adjusted under 35 U.S.C. 154(b) by 0 days.

(21) Appl. No.: 14/995,366

(22) Filed: Jan. 14, 2016

(65) Prior Publication Data

US 2016/0198804 A1 Jul. 14, 2016

Related U.S. Application Data

(60) Provisional application No. 62/103,338, filed on Jan. 14, 2015.

(51) Int. Cl.
*A43C 15/16* (2006.01)

(52) U.S. Cl.
CPC ..... *A43C 15/161* (2013.01); *A43C 15/16* (2013.01); *A43C 15/162* (2013.01)

(58) Field of Classification Search
CPC ..... A43B 5/001; A43C 15/00; A43C 15/02; A43C 15/16; A43C 15/161; A43C 15/162
USPC ..... 36/62, 65, 67 A, 67 D, 127
See application file for complete search history.

(56) References Cited

U.S. PATENT DOCUMENTS

| | | | | |
|---|---|---|---|---|
| 4,445,288 | A * | 5/1984 | Fror | A43C 15/161 36/134 |
| 4,633,600 | A * | 1/1987 | Dassler | A43C 15/161 36/134 |
| 4,644,672 | A * | 2/1987 | Dassler | A43C 15/161 36/134 |
| 5,572,807 | A | 11/1996 | Kelly et al. | |
| 5,848,482 | A | 12/1998 | Bathum | |
| 5,887,371 | A | 3/1999 | Curley | |
| 6,305,104 | B1 * | 10/2001 | McMullin | A43C 15/162 36/127 |
| 6,823,613 | B2 * | 11/2004 | Kelly | A43C 15/161 36/127 |
| 6,834,445 | B2 | 12/2004 | McMullin | |
| 7,073,281 | B2 * | 7/2006 | Terashima | A43C 15/162 36/127 |
| 7,107,708 | B2 | 9/2006 | Kelly et al. | |
| 7,137,213 | B2 | 11/2006 | Kelly et al. | |

(Continued)

OTHER PUBLICATIONS

International Search Report and the Written Opinion, PCT/US2016/13332, dated Jun. 6, 2016, 12 pages.

*Primary Examiner* — Sharon M Prange
(74) *Attorney, Agent, or Firm* — Edell, Shapiro & Finnan, LLC

(57) ABSTRACT

In traction cleat and receptacle system in a shoe outsole, unauthorized cleats are prevented from connection to a receptacle by a projection in the receptacle cavity and a recess in the cleat attachment stem for receiving the projection. A locking arrangement includes an annular array of twelve locking teeth on a boss surrounding the receptacle cavity, wherein every fourth tooth has a steeper side angle to in cooperate with mating cleat locking posts. A cylindrical shroud prevents the locking posts from damaging the outsole material during cleat rotation.

4 Claims, 10 Drawing Sheets

(56) References Cited

U.S. PATENT DOCUMENTS

| | | | | |
|---|---|---|---|---|
| 8,234,799 | B2 * | 8/2012 | Kokavec | A43C 15/161 36/134 |
| 8,245,422 | B2 | 8/2012 | Krikorian et al. | |
| 8,544,195 | B2 * | 10/2013 | Burt | A43C 15/161 36/134 |
| 8,631,591 | B2 * | 1/2014 | Krikorian | A43C 15/168 36/127 |
| 2009/0077833 | A1 | 3/2009 | Kokavec | |
| 2009/0211118 | A1 | 8/2009 | Krikorian et al. | |
| 2010/0257751 | A1 | 10/2010 | Burt et al. | |
| 2014/0165423 | A1 | 6/2014 | Burt et al. | |
| 2015/0135557 | A1 * | 5/2015 | Latraverse | A43C 15/02 36/134 |

* cited by examiner

TRACTION CLEAT AND RECEPTACLE

CROSS REFERENCE TO RELATED APPLICATION

This application claims priority to U.S. Provisional Application No. 62/103,338, filed Jan. 14, 2015, by Pride Manufacturing Company, LLC and entitled "Improved Traction Cleat And Attachment System for Footwear", the disclosure in which is incorporated herein in its entirety by this reference.

ADDITIONAL SUBJECT MATTER INCORPORATED BY REFERENCE

The subject matter disclosed and/or claimed in the following patent documents is expressly incorporated by reference herein in its entirety:

U.S. Pat. No. 5,887,371 (Curley), issued Mar. 30, 1999, for "Footwear Cleat";

U.S. Pat. No. 7,107,708 (Kelly et al), issued Sep. 19, 2006, for "Studded Footwear";

U.S. Pat. No. 7,137,213 (Kelly et al), issued Nov. 21, 2006, for "Studded Footwear";

U.S. Pat. No. 8,245,422 (Krikorian et al), issued Aug. 21, 2012, for "Athletic Shoe Cleat with Dynamic Traction and Method of Making and Using Same";

U.S. Pat. No. 8,544,195 (Burt et al), issued Oct. 1, 2013, for "Method and Apparatus For Interconnecting Traction Cleats and Receptacles";

U.S. Pat. No. 8,631,591 (Krikorian et al), issued Jan. 21, 2014, for "Replaceable Traction cleat For Footwear";

U.S. Patent Application Pub. No. 2009/0211118 (Krikorian et al), published Aug. 27, 2009, for "Traction Cleat For Field Sports"; and US Patent Application Pub. No. 2014/0165423 (Burt et al), published Jun. 19, 2014, for "Traction Cleat and Receptacle".

FIELD OF THE INVENTION

The present invention pertains generally to replacement traction cleat systems for athletic shoes and, more particularly, to improvements in connection and locking arrangements between cleats and their shoe-mounted receptacles in such systems.

Terminology—It is to be understood that, unless otherwise stated or contextually evident, as used herein:

The terms "upper", "lower", "top", "bottom", "vertical", "horizontal", etc., are used for convenience to refer to the orientation of a cleat and receptacle when attached to a shoe sole resting on the ground and are not intended to otherwise limit the structures described and claimed.

The terms "axial", "axially", "longitudinal", "longitudinally", "coaxial", etc., refer to dimensions extending parallel to the axis about which a cleat is rotated in the receptacle and substantially perpendicular to the shoe outsole.

The terms "radial", "radially", "lateral", 'laterally", etc., refer to dimensions extending perpendicularly from the cleat and receptacle rotational axes and substantially parallel to the shoe sole.

The terms "angle", "angular", "rotationally", etc., unless otherwise stated refer to rotation dimensions about the cleat and receptacle rotational axes.

The terms "attach", "attachment", etc., pertain to a longitudinal engagement between the cleat and receptacle that prevents inadvertent axial displacement of the cleat relative to the receptacle.

The terms "lock", "locking", etc., pertain to preventing inadvertent rotational movement between the attached cleat and receptacle.

BACKGROUND

Replacement traction cleats typically include attachment stems that are configured to be received and engaged in cavities in receptacles embedded or otherwise mounted in the outsole of an athletic shoe such as a golf shoe, football shoe, etc. In some cases the engagement stem may be provided on the receptacle and received in a cavity defined in the cleat. In either case, the engagement is typically achieved by rotation of the cleat relative to the receptacle until the cleat and receptacle are locked firmly in place, although mutual engagement without rotation, albeit less desirable, has been suggested in the prior art. In rotational engagement systems the stem and cavity may be threaded, or the rotational engagement may be achieved without threading such as disclosed in the above referenced U.S. Pat. No. 8,544,195 (Burt et al).

OBJECTS AND SUMMARY OF THE INVENTION

In some instances, because of functional, safety or business considerations, it is desirable to assure that only authorized cleats (i.e., cleats with particular structural or functional features, or made by a particular manufacturer, etc.) can be used with a particular receptacle. It is one object of the present invention to provide a cleat and receptacle system that prevents unauthorized cleats from being used with a particular receptacle structure. In one embodiment, wherein the receptacle, mounted in a shoe outsole, has a cavity adapted to rotationally receive and engage (threadedly or otherwise) an engagement stem on a cleat, a projection member extends from the interior end wall (i.e., proximal end wall) of the receptacle cavity. Authorized cleats have a stem with a recess defined in its distal end and configured to receive the receptacle projection member during rotational engagement and thereby permit the cleat stem to be rotationally received and engaged in the receptacle cavity. Unauthorized cleats, not having the stem recess, have their stems impeded or blocked by the receptacle projection member from being inserted into and engaged by the receptacle cavity. For cleat-receptacle systems where the cavity is on the cleat and the stem is on the receptacle, the projection member may be in the cleat cavity and the recess defined in the receptacle stem.

It is also desirable for some applications to have the total height (i.e., the axial length) of the receptacle be as short as possible in order, for example, to permit the receptacle to be mounted in a shoe having a relatively thin outsole. It is important, however, that in reducing the height of the receptacle one does not sacrifice its strength, its ability to retain a cleat therein, and/or its ability to be retained in the outsole when subjected to forces during use. Another object of the invention is to provide a receptacle structure that is short in axial length and constructed so as to resist rupture, resist releasing an engaged cleat and/or resist being torn from a relatively thin outsole. In an embodiment of the present invention the axial length of a receptacle is only 4.0 millimeters.

Another object of the invention is to provide an improved locking arrangement to prevent inadvertent removal of a cleat from a receptacle. Specifically, there is disclosed in the above referenced US Patent Application Pub. No. 2014/0165423 (Burt et al) a locking arrangement of the FAST TWIST® type in which an annular array of angularly spaced locking posts on the cleat hub engage respective locking teeth or stubs projecting radially from the outer surface of a cylindrical boss on the receptacle that surrounds the receptacle cavity. As another feature of the present invention the configurations/locations of the locking posts and locking teeth are modified, and the number of locking teeth is increased to enhance the locking function. Specifically, in one embodiment, twelve locking stubs or teeth are disposed in an annular array on the radially outer surface of the cylindrical boss surrounding the receptacle cavity. Instead of all these locking teeth having the same configuration, three of them (i.e., every fourth tooth in the array) may differ from the other nine, and the trailing edge surface (as considered in the insertion rotation direction) of the three different teeth is provided with a steeper angle so that, in cooperation with the cleat locking posts, reverse rotation of the cleat is more effectively resisted.

In some prior locking systems using the aforementioned FAST TWIST® arrangement, when rotating a cleat, the locking posts on the cleat are forced radially outward by the receptacle locking stubs or teeth and into contact with the material of the outsole in which the receptacle is embedded. Contact with the outsole material can help in the retention of the cleat in the receptacle, but it can be detrimental to the outsole, resulting in loosening the mounting of the cleat therein, and can also make the degree of cleat retention in the receptacle dependent upon the particular material used for the outsole. Another object of the invention is to prevent the locking posts on the cleat from bearing against the outsole material as the cleat is rotated in the receptacle cavity during insertion and removal of the cleat. In order to achieve this, an annular wall, or shroud, is concentrically disposed about and spaced radially outward from the outer wall of the receptacle boss. The shroud is radially positioned such that the locking posts are located radially inward of the shroud, and as the posts ride over the locking teeth and are forced outwardly, the posts make contact with the receptacle shroud, not the outsole material, so that the retention force is predictable and not dependent on different outsole materials.

Another object of the invention is to provide a modified configuration of the dynamic traction elements of a cleat to increase the cleat tractional effect. Specifically, the dynamic traction elements have a curvature both angularly about the cleat rotation axis and axially (i.e., downwardly), and are uniquely arranged in three pairs that are angularly spaced along the base periphery. The angular spacing of the two traction elements in each pair is considerably less than the spacing between the pairs. The arcuate dynamic traction elements extend in a cantilevered manner from the cleat hub and are pivotally flexible in an upward direction about the hub perimetric edge when subjected to the weight of a typical person wearing a shoe in which the cleat is installed. When the traction elements are thusly flexed and spread, the turf-engaging end edges frictionally traverse the turf or other underlying surface to provide one form of traction. In addition, grass blades tend to be trapped between the upper surface of the traction elements and the sole of the wearer's shoe. Further, the arcuate concave and convex edges extending along the entire length of the traction element horizontally engage grass blades as the traction element moves through grass, in either a lateral or rotational direction.

The aforesaid objects, and others that will be evident from the disclosure herein, are achieved individually and in combination, and it is not intended that the present invention be construed as requiring two or more of the objects to be combined unless required by the claims attached hereto.

The above and still further features and advantages of the present invention will become apparent upon consideration of the definitions, descriptions and descriptive figures of specific embodiments thereof set forth herein. In the detailed description below, like reference numerals in the various figures are utilized to designate like components and elements, and like terms are used to refer to similar or corresponding elements in the several embodiments. While these descriptions go into specific details of the invention, it should be understood that variations may and do exist and would be apparent to those skilled in the art in view of the following description.

DETAILED DESCRIPTION OF THE INVENTION

Figure 1:
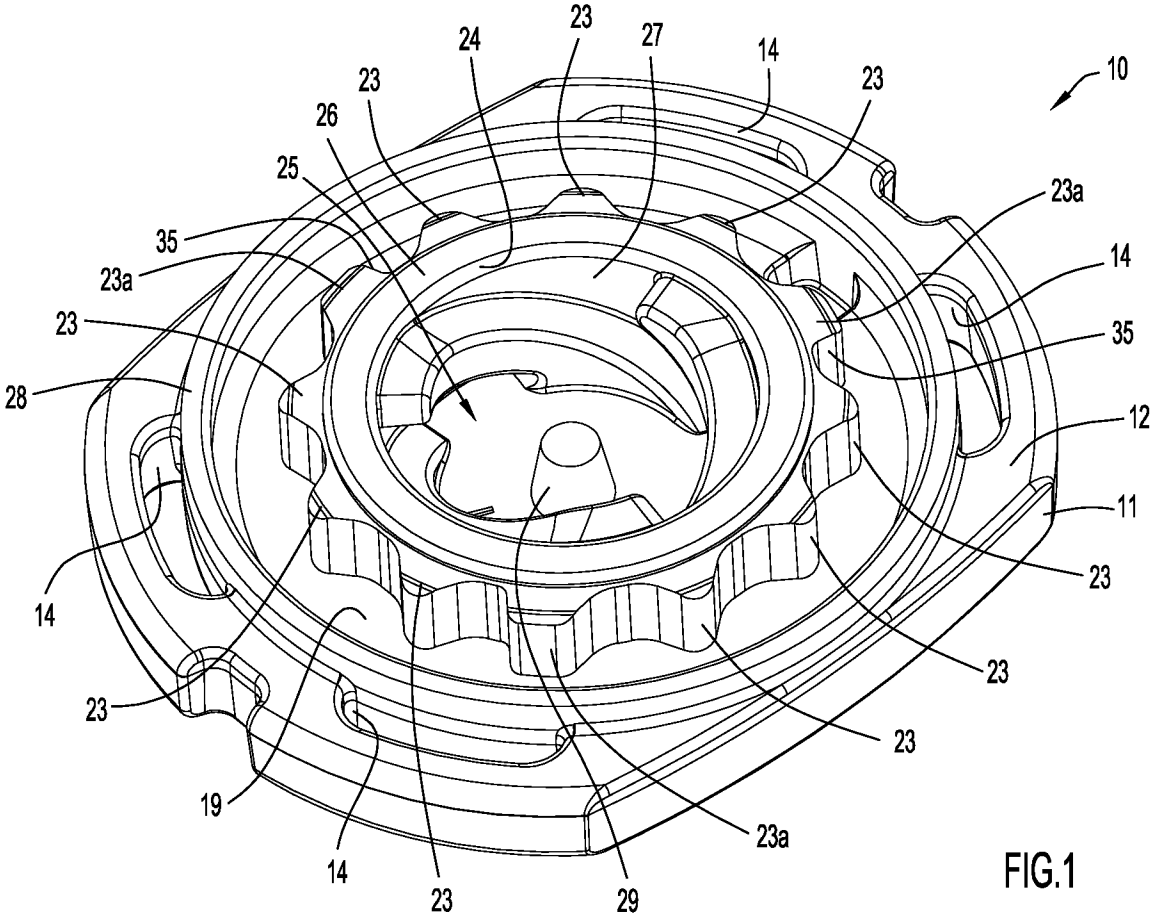
FIG. 1 is a view in perspective from below, showing the engagement side, of a receptacle configured in accordance with a first embodiment of the present invention.
Figure 2:
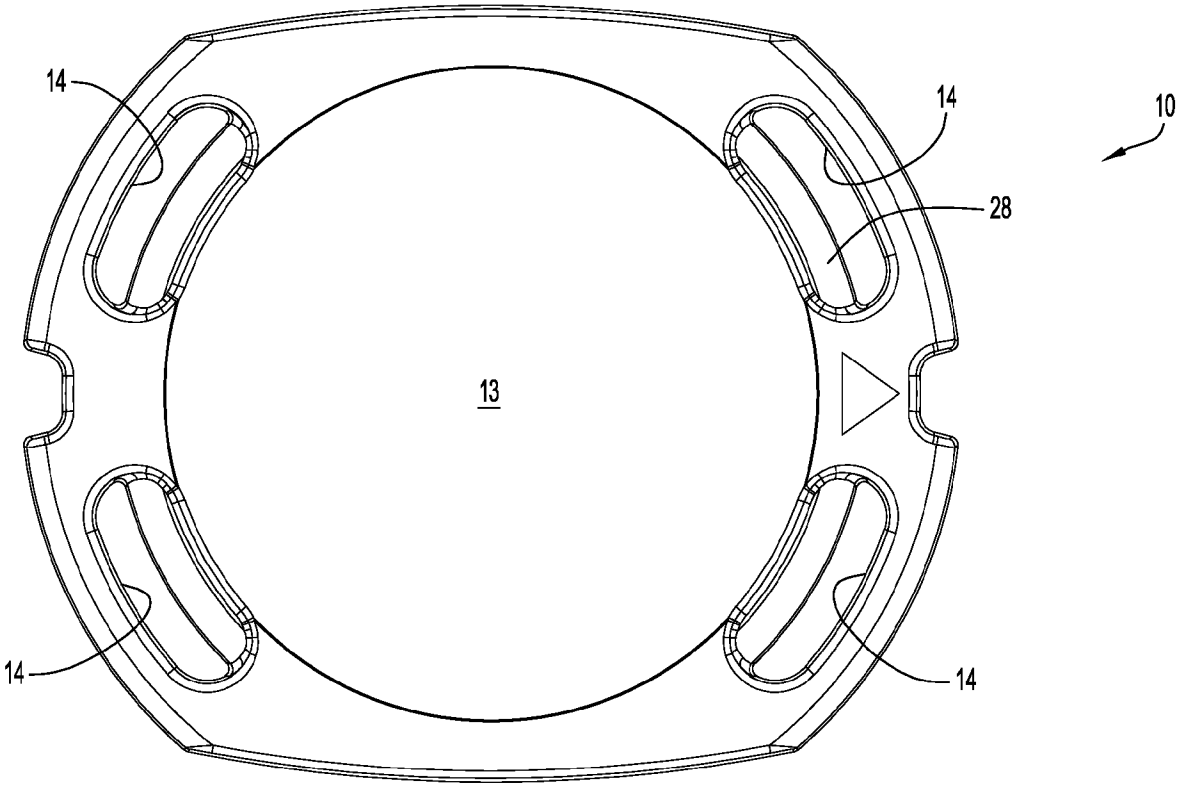
FIG. 2 is a top view in plan of the receptacle of FIG. 1.
Figure 4:
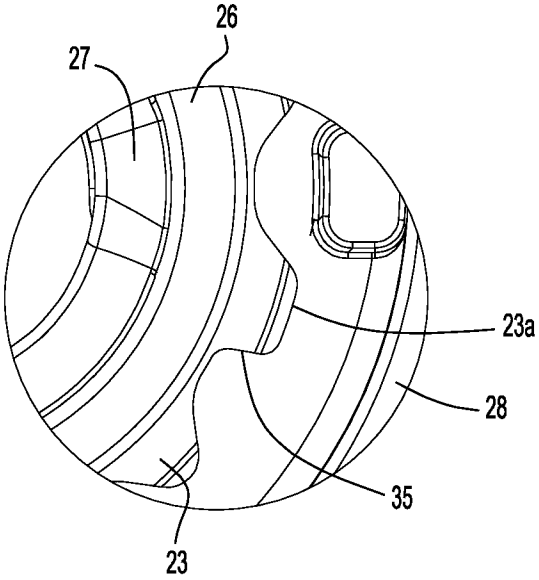
FIG. 4 is a detailed view of a portion of the receptacle enclosed in the detail circle of FIG. 3.
Figure 3:
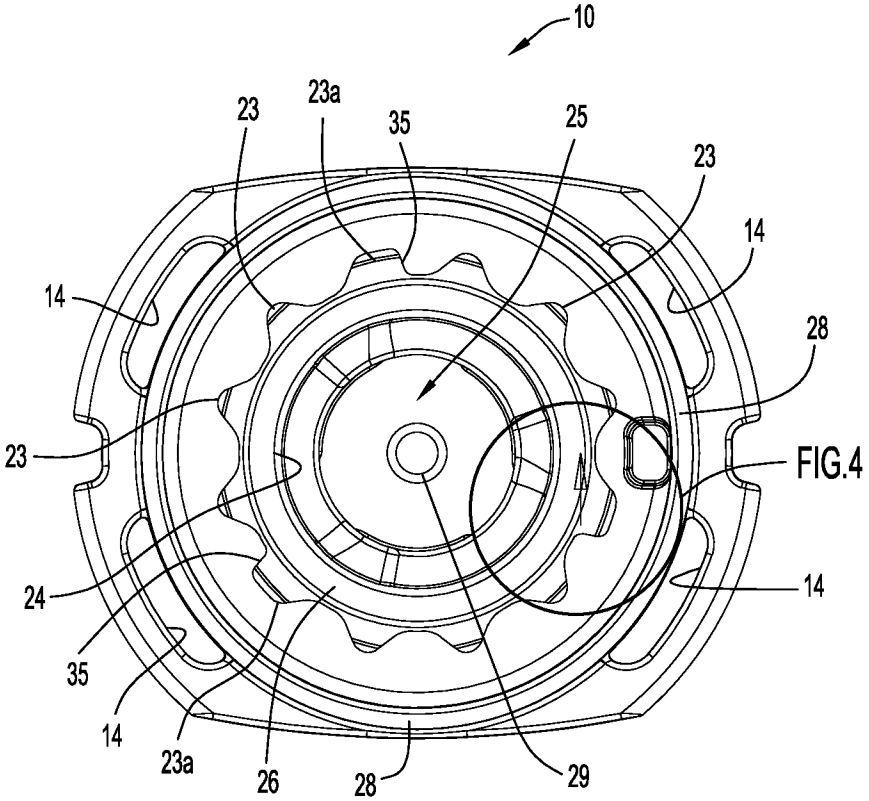
FIG. 3 is a bottom view in plan of the receptacle of FIG. 1.
Figure 5:
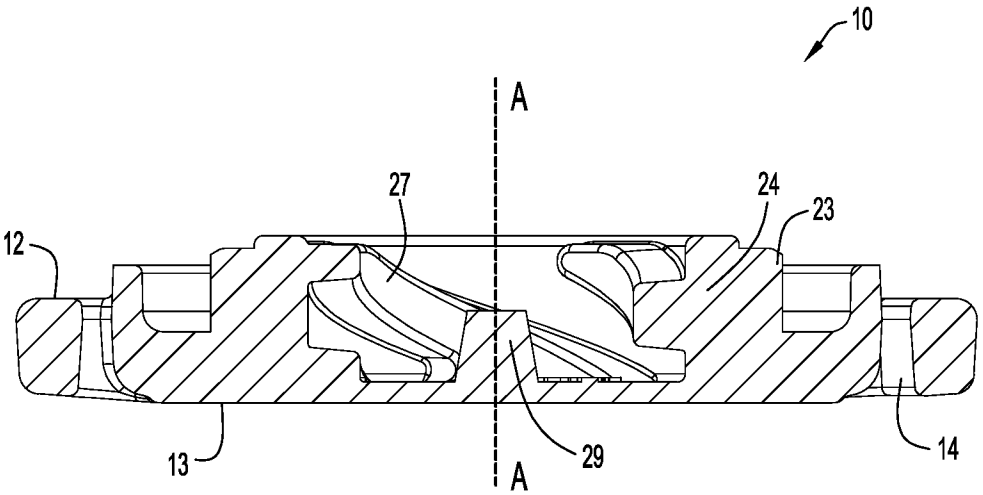
FIG. 5 is a side elevation view in section of the receptacle if FIG. 1.

Referring to FIGS. 1-9 in greater detail, there is illustrated a receptacle 10 (FIGS. 1-5) configured to receive, engage and securely lock in place the cleat 40 (FIGS. 6-9). Receptacle 10 includes a base plate 11 having a bottom surface 12 and a top surface 13. The base plate 11, as illustrated, may be generally rectangular with slightly rounded (i.e., large radius of curvature) opposed long side edges and more rounded (i.e., smaller radius of curvature) opposed shorter side edges; however, the base plate configuration itself is not of itself a feature of the invention and can be otherwise configured, symmetrically or asymmetrically about receptacle attachment axis A. When cleat 40 is installed in receptacle 30, cleat axis B and receptacle axis A are coaxially positioned.

The radially outer portions of base 11 proximate each short side edge have two mounting slots 14 defined longitudinally therethrough (i.e., through the thickness of the base plate) for securing the receptacle in a shoe outsole. Mounting or embedding of the receptacle in a shoe outsole is effected by methods well known in the art and may include molding or otherwise forming the outsole material around and through the mounting slots 14. A generally cylindrical hollow boss 24 projects downwardly (as viewed when the receptacle is mounted in a shoe outsole) from bottom surface 12, centrally on the base 11, and circumferentially defines a hollow generally cylindrical interior cavity 25 disposed concentrically about the receptacle longitudinal axis A. The distal end 26 of the boss is open to provide access for cleat 40 to the cavity. The interior cylindrical wall of the cavity is threaded at 27 with a three-start thread configured to receive and threadedly engage a stem 50 of cleat 40. One of the three engagement threads may have a wider threadform than the other two, allowing it to align with a correspondingly wider threadform on the cleat stem to thereby establish a unique or single starting position for rotational engagement between the cleat and receptacle as is commonly provided when it is desired to have a predetermined final rotational position of the cleat in the receptacle.

A projection member 29 extends within cavity 25 from the proximal end wall of the cavity toward the open distal cavity end. Projection member 29, as illustrated, may be a right frustoconical member having a central longitudinal axis located coaxially with receptacle axis A, with its base at the proximal end wall of the cavity and tapering toward the distal open cavity end. The axial length of projection member 29 is typically at least one-half the axial length of cavity 25 but not so long as to extend beyond the open cavity end. The shape and position of the projection can vary significantly, the limitation being that it must cooperatively function with a recess 51 in the stem 50 of cleat 40 in the manner described below.

By way of example, the truncated cone member 29 may taper from its base at a convergence angle in the range of approximately 14° (i.e., 7° relative to the receptacle axis A) to 20° (i.e., 10° relative to the receptacle axis). The height of the truncated cone above the interior surface of the bottom wall of the receptacle cavity is preferably in the range of 1.70 mm to 1.95 mm.

Twelve equally angularly spaced locking stubs or teeth 23, 23*a*, are disposed in a continuous annular array on the radially outer surface of the cylindrical boss 24. These locking teeth project radially outward from boss 24 and have an axial height slightly shorter, or substantially equal to, the axial length of the boss. Instead of all these teeth having the same configuration, the configuration of three of them (i.e., teeth 23*a*, every fourth tooth in the array) differs from that of the other nine teeth 23. Specifically, as the locking posts 60 of an inserted cleat 40 pass these locking teeth during rotational insertion of the cleat in the receptacle, the posts 60 are forced past the locking teeth 23, 23*a* along mutually resiliently engaging or contacting surfaces until, in the final rotational position, each locking post 60 resides and is retained in a predetermined rotational position relative to respective locking teeth. In order to enhance retention by increasing the resistance to reverse rotation of the cleat, the trailing edge surface 35 (as considered in the insertion direction) of the three different locking teeth 23*a* is provided with a steeper angle than the leading edge surface of locking teeth 23*a*, and both the leading and trailing edge surfaces of teeth 23, so that reverse rotation (i.e., in the disengagement direction) is may be more effectively impeded. For example, trailing edge surface 35 may subtend an angle of 20°±5° with a radius extending from axis A, whereas the leading edge surface of tooth 23*a*, and both the leading and trailing edge surfaces of teeth 23, would typically subtend a shallower angle that varies smoothly along its angular length between 40° and 60°. For this embodiment the radially outward extent of all twelve locking teeth 23, 23*a* from the outer periphery of boss 24 is the same.

A relatively thin annular shroud wall 28 is disposed concentrically about axis A, spaced radially outward from locking teeth 23, 23*a*, and defining an annular space 19 between the shroud and locking teeth for receiving the locking posts 60 of cleat 40. The axial length or height of shroud 28 is typically slightly shorter than the height of boss 24 but preferably equal to the axial length of locking posts 60. The shroud protects against the cleat locking posts being forced into and damaging the outsole material by locking teeth 23, 23*a* during rotation of the cleat in annular space 19. As noted above, during such rotation the cleat locking posts are repetitively forced radially outward by successive receptacle locking teeth. The shroud 28 is radially positioned and configured such that, as the locking posts ride over the locking teeth and are forced outwardly, the posts make contact with the receptacle shroud and not the surrounding outsole material. Shroud 28 may be rigid or slightly flexible; importantly, however, the shroud does not move past and damage the outsole material during rotation of the cleat.

Receptacle 10 can be be fabricated to have an axial length or height as short as four millimeters, and is particularly suited for being molded into outsoles molded from TPU (thermoplastic polyurethane) and rubber when the thickness of the bottom wall of the receptacle is on the order of 0.75 mm thick and the height of the frustoconical projection member 29 is on the order of 1.95 mm.

It will be appreciated that the base plate 11 need not be generally rectangular but can have various configurations dependent on functional, positional and structural considerations. For example, the base plate may have a circular shape which permits six mounting slots 14 to be provided in angularly spaced relation around the entire base for more secure mounting in the outsole material than provided the four mounting slots 14 in the baseplate of the receptacle shown in FIG. 1. In other words, the outsole material would fill two additional slots in a receptacle having a circular base to provide for stronger bonding. In addition, the base plate may have its edge notched or otherwise marked to designate proper positional alignment of the receptacle in an outsole mold during manufacture.

Referring more specifically to FIGS. 6-9, cleat 40 has a threaded attachment stem 50 projecting axially from the top surface of its hub 41 and disposed concentrically about cleat longitudinal axis B for attachment to receptacle 10 described above. The thread on the stem is a three-start outer thread suitable for engaging the three-start interior thread 27 in cavity 25 of the receptacle. The cleat hub 41 is generally circular, also concentrically about axis B, and is defined within an annular perimetric edge 43. The distal insertion end of stem 50 has an axially extending recess 51 defined therein. Recess 51 is configured to receive projection member 29 when stem 50 is inserted in cavity 25 for threaded engagement with the receptacle 10. Specifically, as illustrated, recess 51 may be coaxially disposed with axis B and may have a right frustoconical configuration with its wider open end at the stem distal end and its narrower proximal or interior end at the base of the recess. Recess 51 is extends axially at least 1.0 mm into the distal end of stem 50, and typically extends at least 1.5 mm or more, depending on the length of projection member 29.

It will be appreciated that a cleat without a stem recess 51 cannot be inserted into and engage the cavity 25 of receptacle 10. Specifically, when cavity 25 rotationally receives and engages (threadedly or otherwise) stem 50 on an authorized cleat 40, projection member 29 extends unimpeded into stem recess 51 and permits cleat to receptacle engagement. Unauthorized cleats, not having the stem recess, have their stems blocked by the receptacle projection member 29 from being inserted into and engaged by the receptacle cavity. For cleat-receptacle systems where the cavity is on the cleat and the stem is on the receptacle, the projection member is in the cleat cavity and the recess is defined in the receptacle stem.

The configurations of the cavity projection member 29 and the accommodating stem recess 51 can vary considerably, with the limitations being that the cavity projection member 29 must not interfere with engagement of the stem 50 in the cavity. For example, the recess boundary configuration need not match the periphery of the projection member; rather, the recess configuration is required only to permit the projection member to be unimpededly received therein during and after rotational engagement of the cleat and receptacle. Thus, a conical projection member will serve the intended function with any recess configuration large enough, diametrically and lengthwise, to fully receive the projection member and permit the cleat to be connected to the receptacle. For example, a recess having a cylindrical configuration of sufficient size, positioned as necessary, may function to accommodate the frustoconical projection member. Likewise, the projection member need not be conical or frustoconical; it may have a regular or irregular shape as long as it can be properly received in the cavity recess to permit engagement of an authorized cleat with the receptacle, but block engagement of an unauthorized cleat with the receptacle. It should also be noted that the projection member need not be concentrically disposed about or even located on the rotation axes of the cleat and receptacle, as long as it can be properly received in the cavity recess to permit engagement of an authorized cleat with the receptacle, but block engagement of an unauthorized cleat with the receptacle.

A plurality of angularly spaced dynamic traction elements 53 of cleat 40 have proximal ends secured at or near edge 43 and extend outward and downward therefrom. The dynamic traction elements 53 are uniquely arranged in three pairs that are angularly spaced equally along circumferential periphery of the base. The angular spacing between the two traction elements 53 in each pair is considerably less than the angular spacing between pairs. The dynamic traction elements 53 extend in a cantilevered manner from the cleat hub and are arcuately configured in both downward and angular directions. Specifically, each traction element 53 includes a proximal section extending in an angularly arcuate orientation outward and arcuately downward from the hub peripheral edge 43. The proximal section smoothly arcuately transitions, both angularly and downwardly, into a distal section that turns almost vertically downward while maintaining the angular outward curvature. The distal end of each traction element 53 terminates in a turf-engaging edge 55. In one embodiment the proximal section of each traction element 53 subtends an angle in a vertical plane with the top surface 42 of hub 41 of approximately 30°, and the distal section of each element subtends an angle in that plane of approximately 80°. The angular spacing between the three pairs of traction elements is 120° on center, with the spacing from each element to the closest element in the next adjacent pair being in the range of 0° to 80°. The angular spacing between traction elements in any one pair can vary with the angular thickness of the elements and by design choice but typically varies over the arcuate radial lengths of the arcuate radial lengths between 10° and 30°. An important aspect of traction elements 53 is that, for a cleat with given total diameter, the opposed concave and convex sides of the element are longer than the sides of conventional dynamic traction elements that extend substantially straight radially outward. In other words, the curvature of the traction elements 53 permits longer element sides to exist within a given cleat diameter.

Dynamic traction elements 53 are flexible relative to the hub to achieve three degrees of dynamic traction. Specifically, under the weight of a typical person wearing a shoe in which cleat 40 is installed, each traction element 53 pivotally flexes in an upward direction about the hub perimetric edge 43, and spreads radially outward such that turf-engagement edge 55 is forceful extended along the turf. When the traction elements spread, the turf-engaging edges 55 frictionally traverse the turf or other underlying surface to provide one form of traction. In addition, grass blades tend to be trapped between the upper surface of the traction elements and the sole of the wearer's shoe when the traction elements pivotally flex upwardly. Finally, the radially arcuate configuration of each traction element provides for the longer opposed concave and convex edges extending along the entire length of the element, thereby, as described above, providing greater radial lengths along the element sides than is present in dynamic traction elements having no radial curvature. Those longer edges therefore resiliently engage more grass blades as the elements moves through grass in either a lateral or rotational direction to provide still another degree of traction.

Three locking posts 60 are disposed in angularly spaced relationship in an annular array located concentrically about the cleat axis B. Each locking post 60 has a radially inward facing surface including three angularly spaced protrusions 61, 62, 63 projecting radially inward. A radially outward recess 64 is disposed between protrusions 61 and 62, and another radially outward recess 65 is disposed between protrusions 62 and 63. The locking posts 60 extend perpendicularly upward (i.e., axially) from the top surface 42 of hub 41. The top surface of the locking posts 60 slopes slightly (i.e., increases in axial height) from the leading end proximate protrusion 63 to the trailing end proximate protrusion 61. That top surface abuts the bottom surface of cleat base plate 12 (FIG. 1) in annular space 19 interiorly of shroud 28 as the cleat is tightened in the receptacle. Surface 12 of the base plate in space 19 may be correspondingly ramped to cooperate with the sloping top surface 60 during such tightening. The axial height of the posts, as shown in the illustrated embodiment, may nominally be approximately three millimeters, and the radial thickness of the posts is approximately between one and two millimeters.

Recess 65 in each group of locking posts 60 is configured to cooperate with the differently configured every fourth locking tooth 23*a* (FIG. 1) to aid in resisting rotation between the cleat and receptacle in the removal direction. Specifically, the trailing edge 69 (i.e., trailing in the insertion rotation direction) of recess 65 in each locking post 60 has a steeper slope than the opposite wall in that recess to match the steep slope on the trailing edge 35 of the three differently configured locking teeth 23*a* (FIG. 1). When the cleat is fully inserted and locked into the receptacle, the steeper sloping surfaces abut and strongly resist removal rotation.

More specifically, the radially outward facing terminus of each locking tooth 23 is slightly convex with a small radius of curvature about receptacle axis A; in tooth 23*a* the terminus is flattened. The nadir of recess 64 of each locking post 60 is slightly concave with a radius of curvature about cleat axis B; the nadir of recess 65 is flattened. The radially outward terminus of each locking tooth 23, 23*a* is at a radial distance from receptacle axis A that is slightly greater (e.g., by approximately one millimeter) than the radial distance of the terminus of each protrusion 61, 62, 63 of each post 60 from cleat axis B. This results in an interfering engagement between these termini when they are angularly (i.e., rotationally) aligned. The locking posts 60 are somewhat rigid but sufficiently flexible to be able to bend slightly radially about their bases as the posts rotationally pass the locking teeth during insertion of the cleat in the receptacle. The relatively shallow sloping leading ends of the post protrusions and shallow sloping leading end walls of the teeth facilitate rotation as these surfaces engage and gradually force locking post flexure during insertion rotation. Once the locking posts pass the teeth and reside in angular alignment with the recesses between the stubs, the posts return to their nominal shapes. When cleat stem is fully rotationally inserted in the receptacle cavity, the stem distal end fully receives projection member 29 in recess 51 and substantially abuts the closed end of the cavity 25, and substantially the entire axial lengths of the locking posts 60 are inserted in annular space 19. It is in this final insertion position that the steeper angled trailing ends of the locking post projections and locking teeth fully abut along their axial lengths and preclude mutual rotation between the cleat and receptacle in a direction opposite to the insertion direction.

Figure 6:
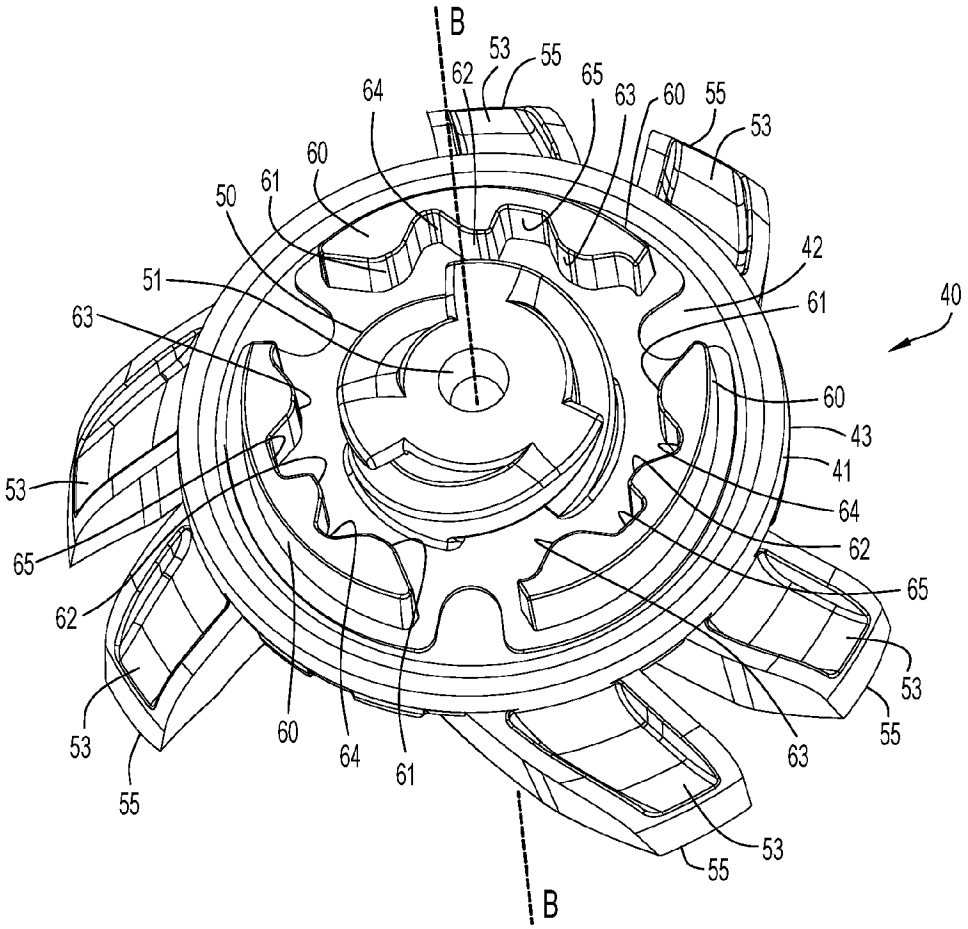
FIG. 6 is a view in perspective from above of a cleat according to the present invention configured to engage a receptacle of the type shown in FIG. 1.
Figure 7:
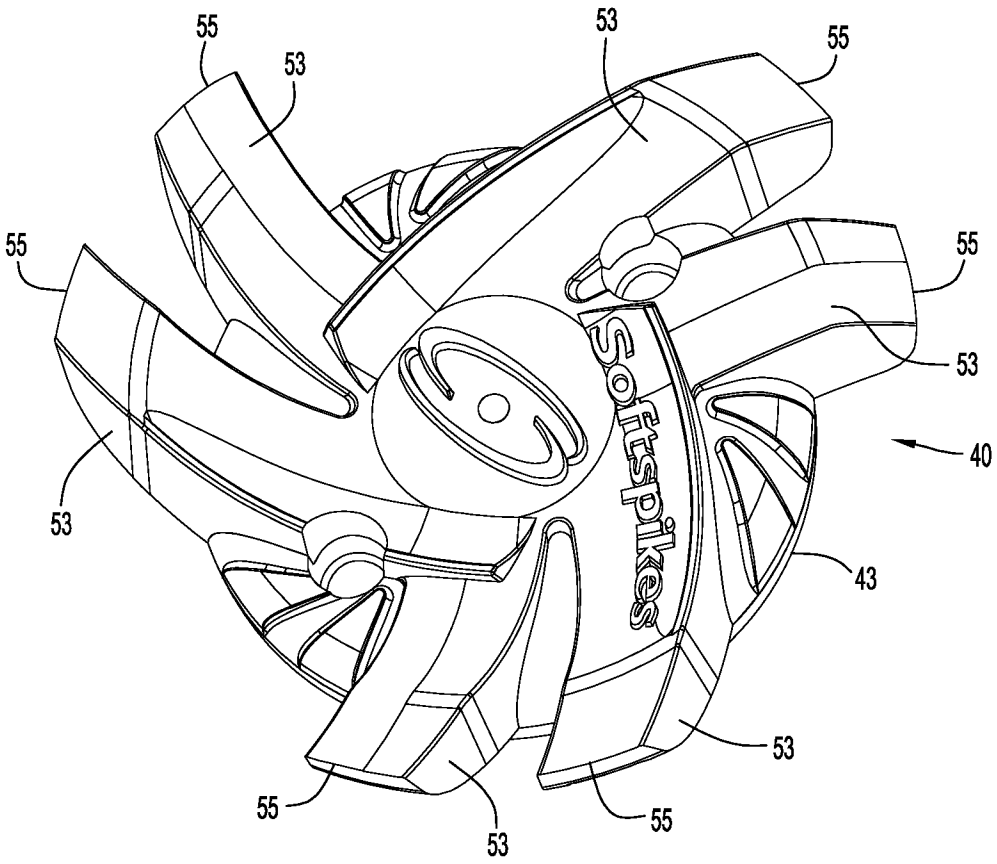
FIG. 7 is a bottom view in plan of the cleat of FIG. 6.
Figure 8:
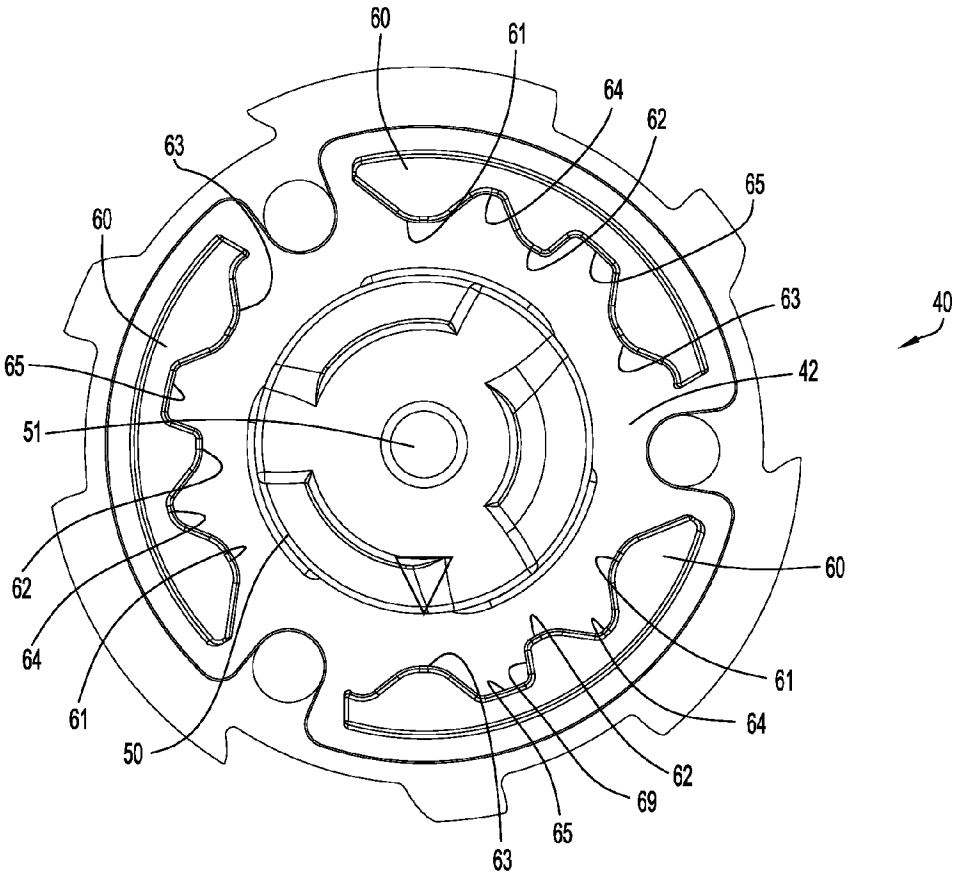
FIG. 8 is a top view in plan of the base portion of the cleat of FIG. 6.
Figure 9:
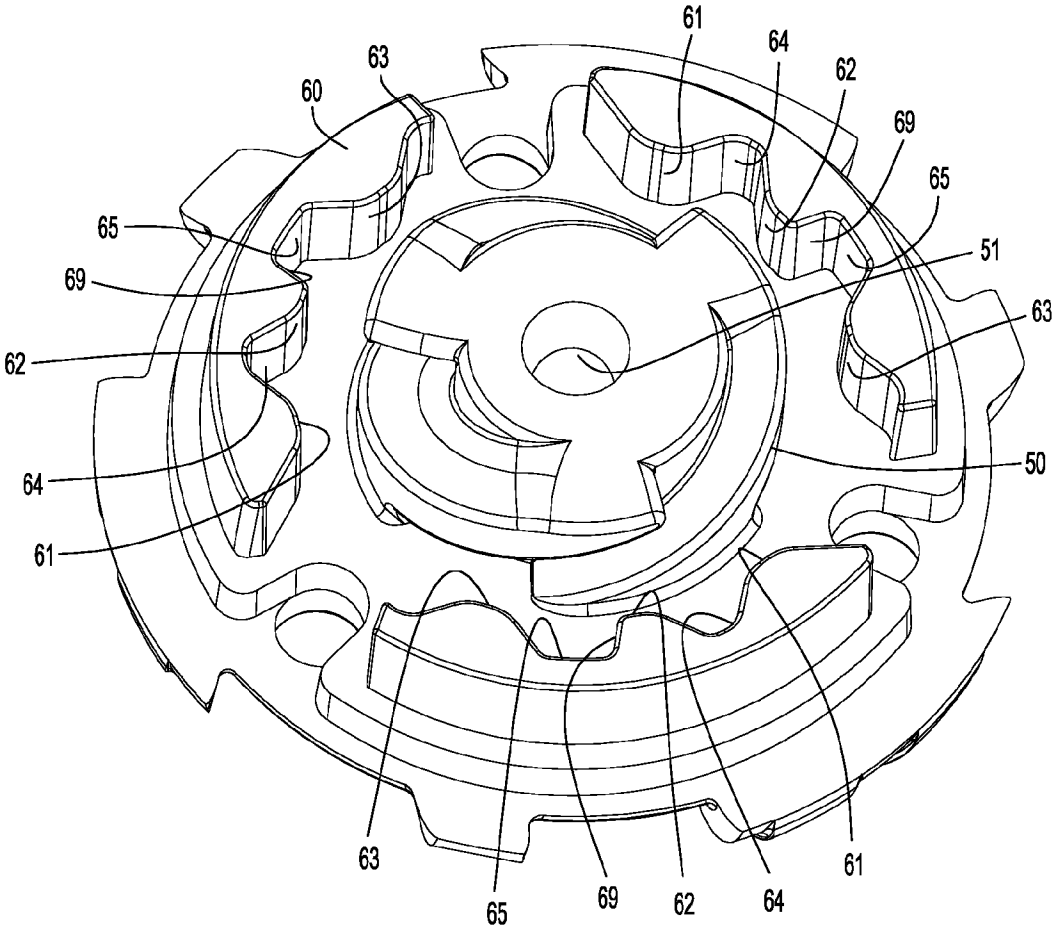
FIG. 9 is a view in perspective of the cleat base portion of FIG. 8.

It should be noted that the features of the cleat in FIG. 6 are mutually exclusive. In particular, it is possible to provide the projection member without the specific illustrated posts 60; instead, other locking post constructions, such as disclosed in the patent documents incorporated by reference hereinabove, may be used as desired or as deemed practical. Likewise, it is possible to use the specific locking post 60 configuration without the projection member and receiving recess; such an arrangement would permit the cleat to be inserted into a receptacle that does not necessarily have a projection member yet it would lockingly engage the receptacle.

Figure 10:
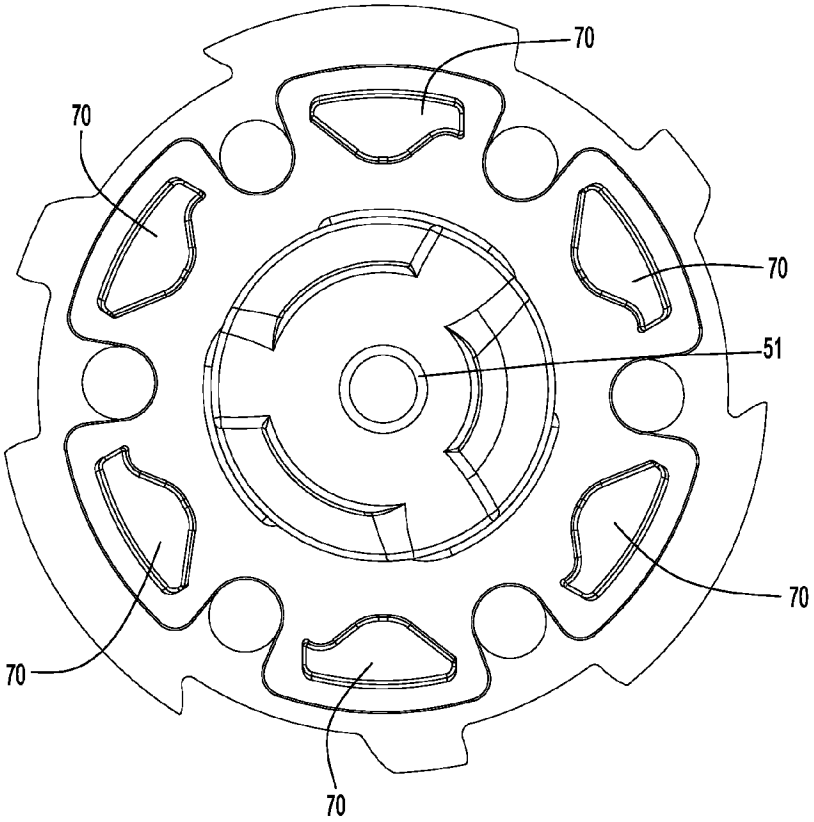
FIG. 10 is a top view in plan of another example of a base portion of a cleat.
Figure 11:
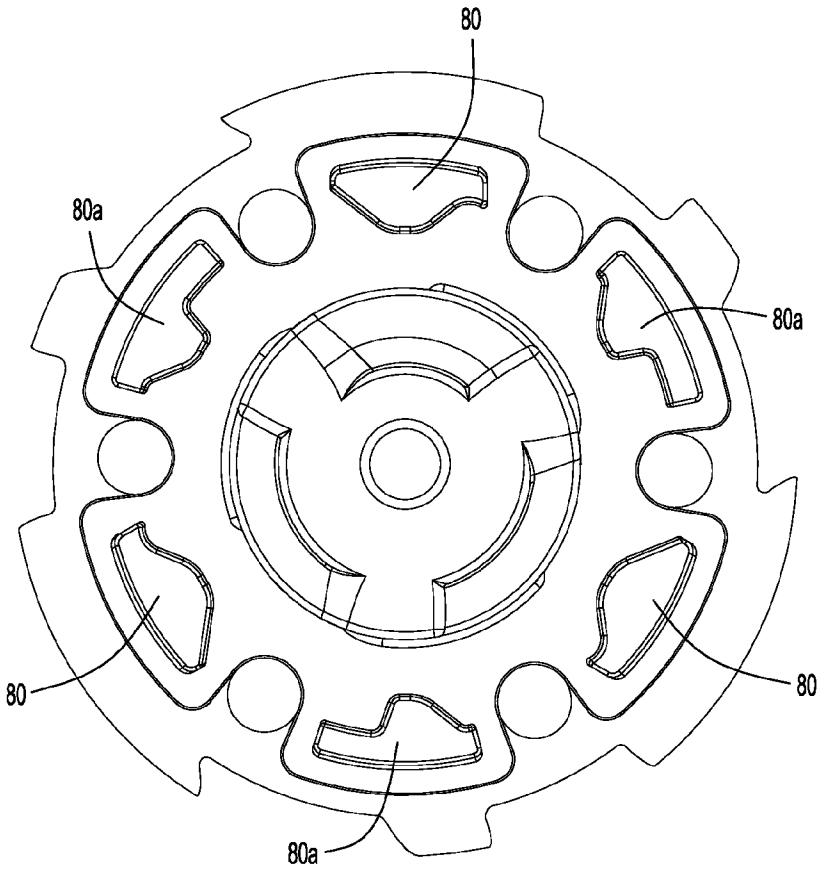
FIG. 11 is a top view in plan of yet another example of a base portion of a cleat.

FIGS. 10 and 11 illustrate respective alternative locking arrangements on a cleat that permit the illustrated cleats to engage the receptacles described above as well as prior FAST TWIST® receptacles. Specifically, instead of locking posts being in three groups of three, six individual locking posts 70 (FIG. 10) and 80, 80*a* (FIG. 11) are provided in equiangular spaced relation. In the FIG. 11 embodiment there are two different locking post structures 80, 80*a* provided, one type 80 being substantially the same as posts 70 and also as described in the above-referenced U.S. Pat. No. 7,107,708 (Kelly et al, incorporated by reference) and illustrated in FIG. 11 thereof. The other post type 80*a* is generally similar, at least functionally, to the middle protrusion 62 (FIG. 6 herein) of the three angularly spaced protrusions extending radially inward in locking post 60, but is a stand alone locking post as opposed to being part of a group of three projections. Specifically, the trailing edge (in the insertion rotation direction) of locking post 80*a* has a steeper slope than its leading edge to match the steep slope on the trailing edge of the three differently configured locking teeth in the receptacle shown in FIG. 1. When the cleat is fully inserted and locked into the receptacle, the steeper sloping surfaces in the cleat and receptacle abut and strongly resist removal rotation. In order to assure this abutment, one selects the starting position of the threaded engagement between the cleat and receptacle, as well as the timing of this engagement.

It will be appreciated that instead of alternating three locking posts 80 and three locking posts 80*a*, only one locking post 80*a* can be used with five locking posts 80. Such an arrangement assures that a cleat can be locked in the proper rotational orientation relative to the receptacle when a specific angular orientation is desired.

Although particular embodiments of a receptacle and cleat and their engagements have been described, other configurations may be employed. For example, although a three-start thread is described and illustrated, two start threads may be used. In addition, a key-in feature mat be provided to assure a defined starting, and resulting final, rotational position of a cleat relative to the receptacle during cleat insertion. The configuration Having described preferred embodiments of new and improved traction cleat and receptacle and various novel components thereof, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. An engagement system for a replaceable traction cleat having a cleat rotation axis and configured to rotationally attach in an insertion direction to a receptacle having an attachment axis and mounted in a shoe sole, the system comprising:

a cleat comprising an engagement stem projecting from said cleat;

a receptacle comprising:

a cavity defined in said receptacle and configured to rotationally receive and engage said stem with said rotation axis and said attachment axis disposed coaxially;

means for preventing an unauthorized traction cleat from being rotationally attached to the receptacle, said means comprising:

a projection member within said cavity, said projection member extending from a proximal end wall of the receptacle cavity and disposed concentrically about said attachment axis;

a recess defined in a distal end of said stem disposed concentrically about said rotational axis and configured to receive said projection member without interference when said cavity rotationally receives and engages said stem;

wherein said projection member blocks cleats having engagement stems that do not have a recess defined therein from being rotationally received and engaged in said cavity, wherein said cleat further comprises:

a hub having a perimetric edge surrounding said rotation axis, a top surface and a bottom surface, wherein said stem extends from said top surface disposed concentrically about said rotation axis;

a set of plural locking posts disposed in angularly spaced relationship in an annular array located concentrically about the cleat rotation axis, each locking post having three radially inward facing protrusions having sloping sides interspersed with radially outward recesses, wherein the slope of one side of one protrusion in each post is steeper than the slope of all other protrusion sides in said each post; and wherein said receptacle further comprises:

a hollow generally cylindrical boss surrounding and defining said cavity;

a continuous annular array of locking teeth projecting radially outward from said boss for engaging said locking posts in locking relation when said stem is fully inserted in said cavity, wherein selected spaced locking teeth have a different configuration than the remaining locking teeth to abut the said one of said protrusions to block rotation in a direction opposite said insertion direction of said stem in said cavity.

2. The engagement system of claim 1, further comprising an annular cylindrical shroud concentrically disposed about and spaced radially outward from the receptacle boss to define an annular space therebetween for axially receiving said locking posts and preventing the locking posts from being resiliently deflected radially beyond the shroud.

3. An engagement system for a replaceable traction cleat having a cleat rotation axis and configured to rotationally attach in a rotational insertion direction to a receptacle having an attachment axis and mounted in a shoe sole, the system including:

a cleat comprising:

a hub having a perimetric edge surrounding said rotation axis, a top surface and a bottom surface;

an engagement stem extending from said top surface disposed concentrically about said rotation axis, said stem having a distal end with a recess defined and extending axially in the stem;

a set of plural locking posts disposed in angularly spaced relationship in an annular array located concentrically about the cleat rotation axis, each locking post having three radially inward facing protrusions having sloping sides interspersed with radially outward recesses, wherein the slope of one side of one protrusion in each post defines, in the rotational insertion direction of said cleat, a trailing side surface of one said recess that is steeper than the slope of all of other protrusion sides in said each post; and a receptacle comprising:

a hollow generally cylindrical boss defining a cavity defined therein, said cavity configured to rotationally receive and engage said stem with said rotation axis and said attachment axis disposed coaxially;

a projection member in said cavity disposed concentrically about said attachment axis;

a continuous annular array of locking teeth projecting radially outward from and completely surrounding said boss for engaging said locking posts in locking relation when said stem is fully inserted in said cavity, wherein selected spaced locking teeth have a trailing edge surface in the rotational insertion direction of said cleat that is steeper than the remaining locking teeth to abut the steeper trailing side surface of said one of said protrusions to block rotation in a direction opposite said rotational insertion direction of said cleat, wherein said recess defined in said stem is configured to receive said projection member without interference when said cavity rotationally receives and engages said stem, and wherein said projection member blocks cleats having engagement stems without a recess defined therein from being rotationally received and engaged in said cavity.

4. The engagement system of claim 3, wherein the recess extends axially in the stem to a length of at least one millimeter.

* * * * *